US012358699B2

(12) United States Patent
Dong

(10) Patent No.: US 12,358,699 B2
(45) Date of Patent: Jul. 15, 2025

(54) THERMAL INSULATION CANISTER

(71) Applicant: Hangzhou Endoom Technology Co.. Ltd., Zhejiang (CN)

(72) Inventor: Dong Dong, Zhejiang (CN)

(73) Assignee: Hangzhou Endoom Technology Co., Ltd., Hangzhou (CN)

( * ) Notice: Subject to any disclaimer, the term of this patent is extended or adjusted under 35 U.S.C. 154(b) by 0 days.

(21) Appl. No.: 18/972,501

(22) Filed: Dec. 6, 2024

(65) Prior Publication Data

US 2025/0187799 A1 Jun. 12, 2025

(30) Foreign Application Priority Data

Dec. 7, 2023 (CN) ..... 202311666090.3
Dec. 7, 2023 (CN) ..... 202323321484.3

(51) Int. Cl.
*B65D 51/16* (2006.01)
*B65D 43/02* (2006.01)
(Continued)

(52) U.S. Cl.
CPC ..... *B65D 51/1644* (2013.01); *B65D 43/0218* (2013.01); *B65D 51/243* (2013.01); *B65D 53/02* (2013.01); *B65D 81/3811* (2013.01); *B65D 2543/00092* (2013.01); *B65D 2543/00231* (2013.01); *B65D 2543/005* (2013.01);
(Continued)

(58) Field of Classification Search
CPC ..... B65D 2543/00092; B65D 2543/00231; B65D 2543/005; B65D 2543/00537; B65D 2543/00555; B65D 2543/00879; B65D 2543/00972; B65D 51/1644;
(Continued)

(56) References Cited

U.S. PATENT DOCUMENTS 8,807,370 B2 * 8/2014 Lee ..... B65D 45/327 220/378
2014/0054301 A1 * 2/2014 Guoqing ..... B65D 51/242 220/521
(Continued)

FOREIGN PATENT DOCUMENTS

CN 212213347 U * 12/2020 ..... A45F 3/16
CN 217075381 U * 7/2022 ..... B65D 25/2858
(Continued)

*Primary Examiner* — Nathan J Jenness
*Assistant Examiner* — Madison L Poos

(57) ABSTRACT

A thermal insulation canister includes a canister body and a thermal insulation cover. The thermal insulation cover includes an upper cover body, a sealing ring, an adjusting frame, a pressure valve, a trigger and an inner cover body, each of two sides of the trigger is equipped with a trigger connecting shaft, the upper cover body is equipped with two installation holes. The trigger connecting shaft is slidably connected to the installation hole. Two adjusting shafts are fixedly installed on an upper end surface of the adjusting frame. The two adjusting shafts passes is rotatably connected with the trigger connecting shaft. The trigger connecting shaft is configured to drive the adjusting shaft to move in a vertical direction. The sealing ring is positioned between the upper cover body and the adjusting frame. The canister body is further equipped with an inner canister body.

12 Claims, 15 Drawing Sheets

(51) Int. Cl.
*B65D 51/24* (2006.01)
*B65D 53/02* (2006.01)
*B65D 81/38* (2006.01)

(52) U.S. Cl.
CPC ..... *B65D 2543/00537* (2013.01); *B65D 2543/00555* (2013.01); *B65D 2543/00879* (2013.01); *B65D 2543/00972* (2013.01)

(58) Field of Classification Search
CPC .. B65D 51/243; B65D 53/02; B65D 81/3811; B65D 81/3837; B65D 81/3841
USPC ..... 215/358–362; 220/234–238, 259.2, 220/592.27
See application file for complete search history.

(56) References Cited

U.S. PATENT DOCUMENTS

| | | | | |
|---|---|---|---|---|
| 2021/0053731 | A1* | 2/2021 | Lane | B65D 41/465 |
| 2021/0269200 | A1* | 9/2021 | Ou | B65D 51/242 |
| 2022/0039574 | A1* | 2/2022 | Yang | A47G 19/2205 |

FOREIGN PATENT DOCUMENTS

| | | | | |
|---|---|---|---|---|
| CN | 218056541 U | * | 12/2022 | B65D 43/022 |
| KR | 20170139284 A | * | 12/2017 | |

* cited by examiner

THERMAL INSULATION CANISTER

CROSS-REFERENCE TO RELATED APPLICATIONS

The present invention claims priorities of Chinese patent applications CN202311666090.3 and CN202323321484.3, filed on Dec. 7, 2023, which are incorporated herein by references in its entireties.

TECHNICAL FIELD

The present invention relates to the technical field of thermal insulation containers, in particular to a thermal insulation canister.

BACKGROUND

Existing thermal insulation canisters usually adopt two fixed methods for the connection between the thermal insulation cover and the canister body, namely screw threads and quick-opening mechanisms. For the screw thread fixing method, screw threads need to be set on both the thermal insulation cover and the canister body. When cleaning the thermal insulation canister, it is rather difficult to clean the impurities in the screw thread gaps. Moreover, after the internal temperature of the thermal insulation canister drops, the air pressure difference between the inside and outside of the thermal insulation canister will make it hard to open the cover of the canister. Meanwhile, the disadvantage of the existing quick-opening thermal insulation canisters is that the locking force is insufficient. The covers may be pushed open by the steam generated from high-temperature food liquids and thus fail to achieve a proper seal, especially in the case of canisters with large diameters.

Therefore, how to design a new structure for thermal insulation canisters has been a problem under continuous research at the present stage. In response to the above problems, a solution is proposed as follows.

SUMMARY

The present disclosure aims to provide a thermal insulation canister, which has the advantages of convenient opening, safe self-locking, rapid disassembly and cleaning, and excellent heat preservation effect.

The above technical objective of the present invention is achieved through the following technical solutions.

Embodiment I

A thermal insulation canister includes a canister body and a thermal insulation cover.

The thermal insulation cover includes an upper cover body, a sealing ring, an adjusting frame, a pressure valve, a trigger and an inner cover body, the trigger is arranged on the upper cover body, each of two sides of the trigger is equipped with a trigger connecting shaft, the upper cover body is equipped with two installation holes, and one end of the trigger connecting shaft is positioned within the installation hole and is slidably connected to the installation hole; two adjusting shafts are fixedly installed on an upper end surface of the adjusting frame, each of upper ends of the two adjusting shafts passes through the installation hole and is rotatably connected with the trigger connecting shaft, the adjusting shaft is connected with a junction of a raised portion and a connecting portion of the trigger connecting shaft, the trigger connecting shaft is configured to drive the adjusting shaft to move in a vertical direction, the sealing ring is positioned between the upper cover body and the adjusting frame, an upper end of the sealing ring is inserted and fixed with a lower end surface of the upper cover body, a lower end of the sealing ring is contacted with the upper end surface of the adjusting frame, a thermal insulation layer is arranged inside the adjusting frame, the pressure valve is installed on the adjusting frame, and the pressure valve is configured to release pressure in the canister body; the canister body is further equipped with an inner canister body, the inner cover body is fixed on an upper end of the inner canister body, the inner canister body is clamped and fitted with an inner wall of the canister body, the trigger is of a cam structure, and the trigger pulls the adjusting frame by the cam structure to make the sealing ring stretch and slide, thereby locking the canister body.

Preferably, the upper cover body includes an upper cover plate and an upper protection plate, the upper protection plate is fixed on a lower end surface of the upper cover plate, the lower end surface of the upper cover plate is equipped with an upper installation slot, an outer edge of the upper protection plate protrudes upward and is clamped into the upper installation slot, a lower end surface of the upper protection plate is equipped with an outer ring groove and an inner ring groove, an upper end of the canister body is inserted and fitted with the outer ring groove, and an upper end of the sealing ring is inserted and fitted with the inner ring groove.

Preferably, the adjusting frame includes an adjusting plate and a bottom plate, the thermal insulation layer is arranged between the adjusting plate and the bottom plate, the bottom plate is clamped and fixed on a lower end surface of the adjusting plate, a center of the lower end surface of the adjusting plate is equipped with a central shaft, the lower end surface of the adjusting plate is further equipped with a plurality of spoke edges and annular edges, the plurality of spoke edges are arranged surrounding the central shaft, one end of the spoke edge is connected to the central shaft, the other end of the spoke edge extends to an outer edge of the adjusting plate, a diameter of the annular edge is greater than a diameter of the central shaft, the annular edge connects all of the spoke edges, the spoke edge and the annular edge are configured to increase firmness of the adjusting frame, an outer edge part of an upper end surface of the adjusting plate is equipped with a downward recessed abutting groove, a lower end of the sealing ring is equipped with an abutting ring, and the abutting ring abuts against an upper end surface of the abutting groove.

Preferably, a lower end surface of the inner cover body is equipped with a circle of sealing ring, an outer side of the sealing ring is in an arc shape, a diameter of an outermost side of the sealing ring is less than a diameter of an outermost side of the inner cover body, a plurality of reinforcing edges are fixedly installed on the lower end surface of the inner cover body, and the reinforcing edge is configured to increase strength of the inner cover body.

Preferably, the canister body is further equipped with an outer canister body, an inner wall of the outer canister body is equipped with two circles of clamping edges protruding inward, the two clamping edges are respectively an upper clamping edge and a lower clamping edge, an inner circle diameter of the lower clamping edge is less than an inner circle diameter of the upper clamping edge, the upper end of the inner canister body is equipped with a retaining ring folded outward, an outer diameter of the retaining ring is less than an inner circle diameter of the upper clamping edge, and the outer diameter of the retaining ring is greater than an inner circle diameter of the lower clamping edge.

Preferably, the outer canister body includes an outer casing and an inner casing, an interlayer thermal insulation layer is arranged between the outer casing and the inner casing, the upper clamping edge and the lower clamping edge are respectively arranged on the inner casing, an upper end of the outer casing is equipped with an abutting platform recessed inward, a distance between the outer casing and the inner casing positioned above the abutting platform is less than a distance between the outer casing and the inner casing positioned below the abutting platform.

Preferably, a part of the outer canister body positioned above the abutting platform is an insertion portion, the insertion portion of the outer canister body is in insertion fit with the outer ring groove, and a lower end surface of an outermost side of the upper cover body abuts against the abutting platform.

Preferably, an upper end surface of the upper cover body is equipped with a storage groove, the storage groove is configured to place tableware, the storage groove is equipped with a storage cover, one side of the storage cover is hinged to the storage groove, and the other side of the storage cover is clamped and fixed to the storage groove.

Preferably, the upper cover body is further equipped with a handle ring, and the handle ring is hinged to the upper cover body.

Preferably, an annular pad is embedded in a lower end surface of the outer casing, the annular pad is fixedly connected to the outer casing, and a position of a lowest end of the annular pad is lower than a position of a lowest end of the outer casing.

The beneficial effects of the present invention are as follows:

The traditional screw thread connection is replaced by the clamping method, which reduces the issue that the thermal insulation cover is difficult to open due to the air pressure difference between the inside and outside of the canister body. The fixation between the canister body and the thermal insulation cover depends on the cooperation between the upper clamping edge on the inner wall of the canister body and the sealing ring. When the sealing ring is compressed, the middle part of the sealing ring protrudes outward. The adjusting frame further moves upward so that the inclined plane of the adjusting frame abuts against the sealing ring, and the protruding part of the sealing ring is positioned below the upper clamping edge, making the thermal insulation cover and the canister body completely locked and unable to be detached. Then the internal pressure valve starts to work. When the pressure exceeds the set value, the pressure valve automatically opens to relieve the pressure. When the sealing ring is not compressed, the outer wall of the sealing ring will not contact the upper clamping edge, enabling the thermal insulation cover to be conveniently removed from the canister body. The state of the sealing ring is adjusted by the adjusting frame. When the adjusting frame moves upward, it will compress the sealing ring, and when the adjusting frame moves back downward, the sealing ring will stretch. When the trigger drives the adjusting shaft to move, it will drive the adjusting frame to move. The trigger itself realizes the drive of the adjusting shaft through a lever structure, so that the trigger can use a relatively small force to achieve the adjustment of the state of the sealing ring.

The present invention also provides a thermal insulation canister includes a canister body and a thermal insulation cover.

The thermal insulation cover includes an upper cover body, an adjusting frame, a lower cover body and a sealing ring, the upper cover body is equipped with an installation slot, a trigger is arranged inside the installation slot, one end of the trigger is positioned inside the installation slot and is rotatably fitted with the installation slot, the adjusting frame is symmetrically equipped with two adjusting columns, an upper end surface of one end of the adjusting column is an inclined plane, the two adjusting columns are respectively positioned on two sides of the installation slot without a sidewall, the two sides of the installation slot are not equipped with the sidewall, the adjusting column is extended into the installation slot, the trigger is equipped with a column hole channel, the adjusting column is inserted into the column hole channel and is rotatably connected to the column hole channel, the lower cover body is clamped and connected with the adjusting frame, the sealing ring is positioned at an outer edge of the lower cover body, an upper end of the sealing ring is snapped into a lower end surface of the upper cover body, a lower end of the sealing ring abuts against an upper end surface of the lower cover body, the lower cover body moves up and down following the adjusting frame, so that the sealing ring is compressed or stretched, a clamping structure is arranged at an upper position of an inner cavity of the canister body, when the sealing ring is compressed, it is clamped and fixed with the clamping structure, when the sealing ring is stretched, it is slidably connected with the clamping structure, the trigger is of a cam structure, and the trigger pulls the adjusting frame by the cam to make the sealing ring stretch or slide, thereby locking the canister body.

Preferably, the lower end surface of the upper cover body is equipped with an annular groove, the upper end of the sealing ring is equipped with an upper abutting ring bent outward, the upper abutting ring is perpendicular to the upper end of the sealing ring, a transverse width of the upper abutting ring is equal to a width of the annular groove, the lower end of the sealing ring is equipped with a lower abutting ring bent inward, the lower cover body includes a lower cover plate and a lower annular sleeving plate, the lower annular sleeving plate is positioned on an upper end surface of the lower cover plate, a diameter of the lower cover plate is greater than a diameter of the lower annular sleeving plate, and the lower abutting ring is sleeved on an outside of the lower annular sleeving plate and is attached to the upper end surface of the lower cover plate.

Preferably, cross-sections of the upper end and the lower end of the sealing ring are arranged in a vertical direction, the lower end of the sealing ring is positioned at an outer position below the upper end, a middle part of the sealing ring is connected to the upper end and the lower end, and the middle part is arranged in an inclined manner.

Preferably, an outer sidewall of the adjusting frame is also circular, a diameter of the adjusting frame is less than the diameter of the lower annular sleeving plate, the lower annular sleeving plate is sleeved on an outside of the adjusting frame, a plurality of outer clamping stripes are fixedly arranged on the outer sidewall of the adjusting frame, the outer clamping stripes are arranged obliquely along an outer wall of the adjusting frame, a plurality of inner clamping blocks are fixedly arranged on an inner wall of the lower annular sleeving plate, the inner clamping block is in sliding fit with the outer clamping stripe, an outer clamping block is arranged adjacent to a highest position of the outer clamping stripe, each of two sides of the inner clamping block and the outer clamping block is inclined plane, and the inner clamping block is clamped onto the outer clamping stripe through the outer clamping block.

Preferably, the canister body is of a double-layer design, the canister body includes an outer casing and an inner casing, the clamping structure is formed by bending an upper end of the canister body inward, and a diameter of the clamping structure is less than a diameter of the inner cavity of the canister body.

Furthermore, the beneficial effects of the present invention are as follows:

During use, simply rotate the trigger to the horizontal position. At this time, one end of the trigger will drive the adjusting frame to move upward through the adjusting column. The lower cover body is clamped and fixed with the adjusting frame and will move upward synchronously with the adjusting frame. The lower cover body will drive the lower end of the sealing ring to move upward. Since the upper end of the sealing ring cannot move and, in the horizontal direction, the lower end of the sealing ring is positioned at a more outer position than the upper end, the sealing ring will bend outward. After bending, the diameter of the sealing ring will be greater than that of the lower cover body, and the outer side of the sealing ring will abut against the clamping structure on the inner wall of the canister body, making it impossible to detach the thermal insulation cover from the canister body. When it is necessary to remove the thermal insulation cover from the canister body, rotate the trigger upward to make the trigger in a vertical state. At this time, the trigger will drive the adjusting frame to move downward through the adjusting column, and the lower cover body will also move downward, no longer generating an upward thrust on the lower end of the sealing ring. The sealing ring will return to the stretched state under the action of its own elastic force, and there will be no contact between the sealing ring and the clamping structure, so that the thermal insulation cover can be conveniently removed from the canister body. Since the threaded design is not adopted, the sidewalls and inner walls of the thermal insulation cover and the canister body are all smooth planes, thus making the cleaning of the thermal insulation cover and the canister body more convenient.

DETAILED DESCRIPTION OF THE EMBODIMENTS

Figure 1:
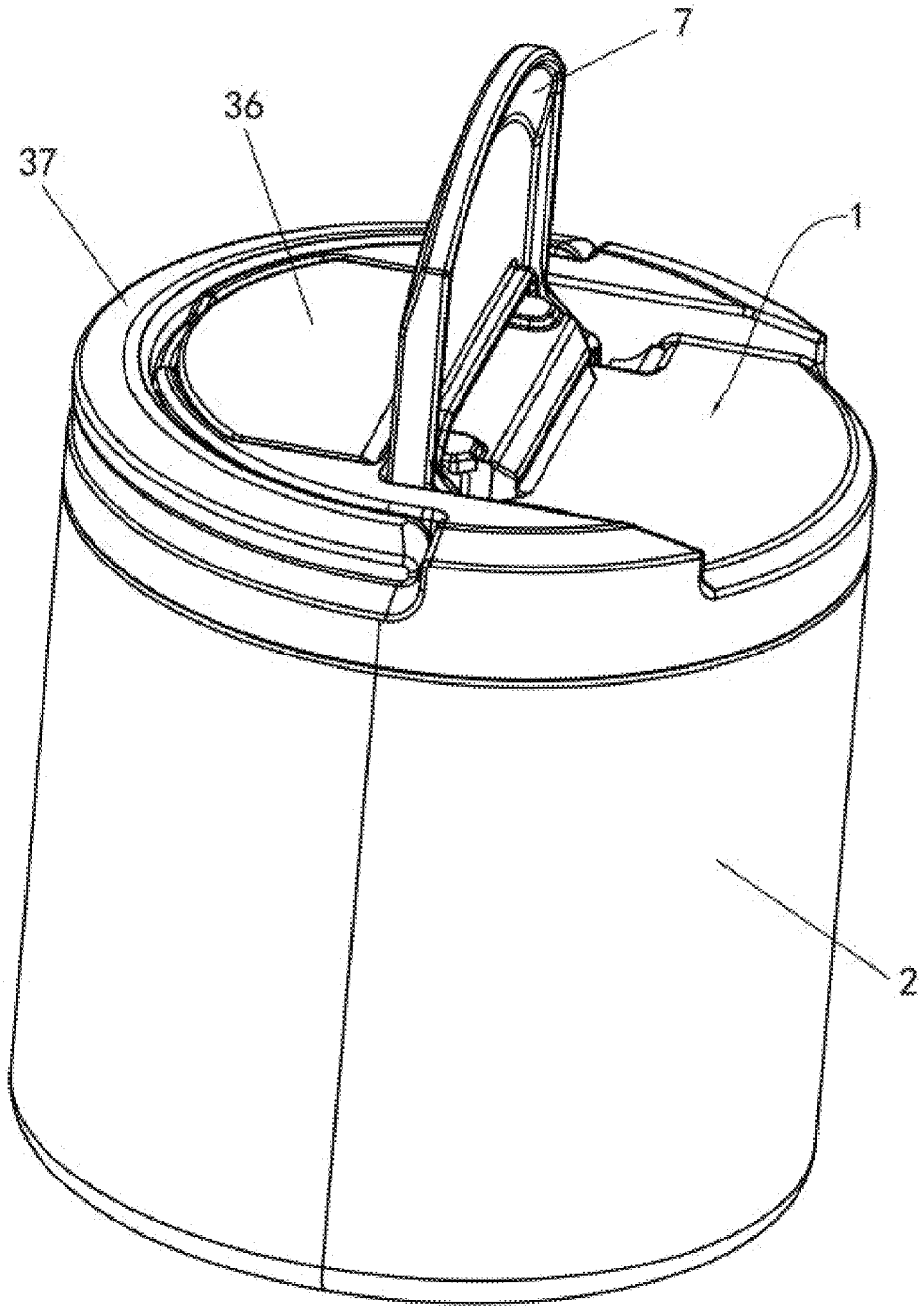
FIG. 1 is a schematic structural diagram according to Embodiment I.

The following is only the preferred embodiment of the present invention, and the scope of protection is not limited to this embodiment only. Furthermore, any technical solution that falls within the inventive concept of the present invention should belong to the scope of protection of the present invention. The same components are represented by the same reference numerals. It should be noted that the terms "front", "rear", "left", "right", "upper" and "lower" used in the following description refer to the directions in the drawings, and the terms "bottom" and "top", "inner" and "outer" respectively refer to the directions toward or away from the geometric center of a specific component.

Embodiment I

Figure 2:
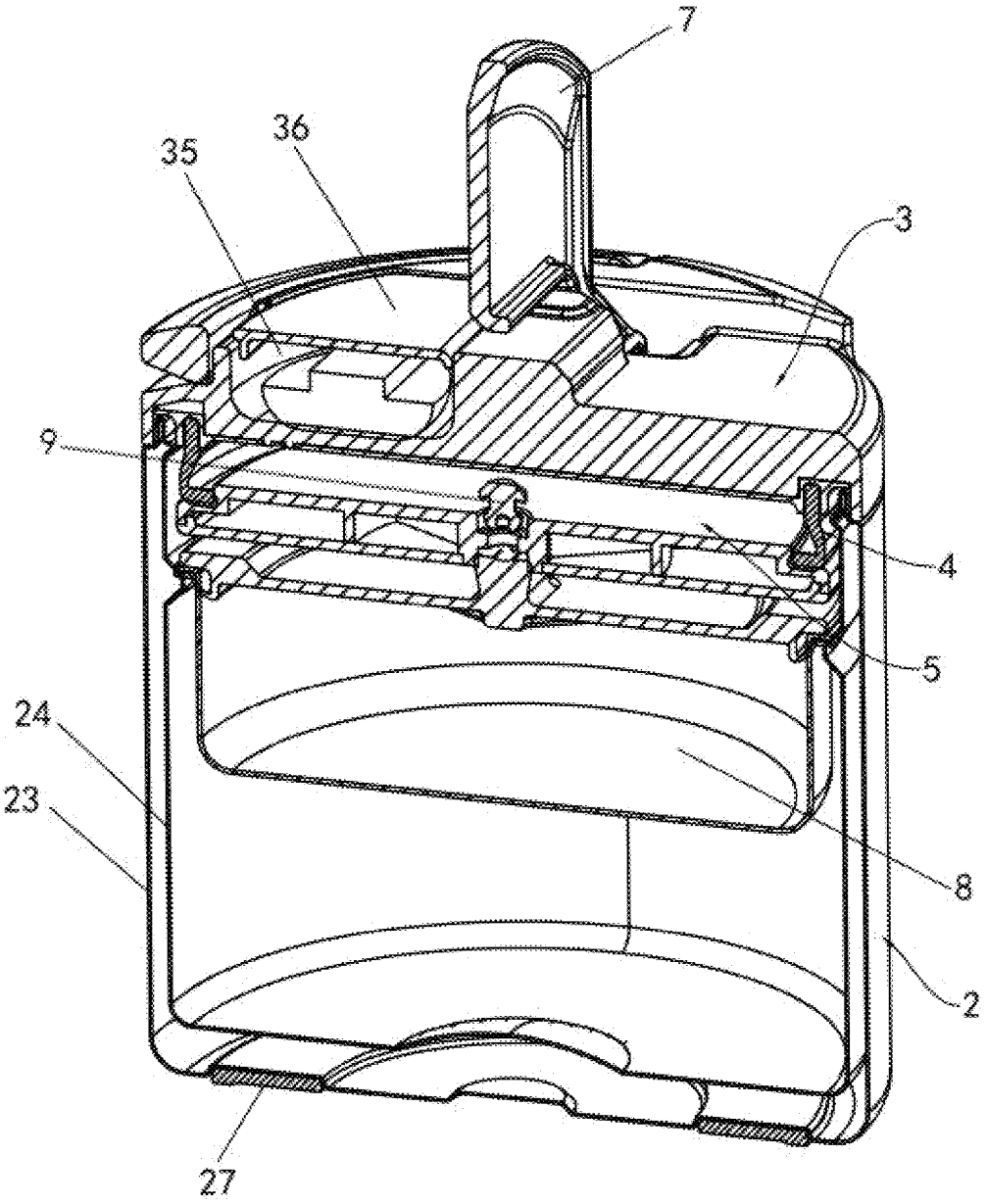
FIG. 2 is a sectional diagram according to Embodiment I.
Figure 3:
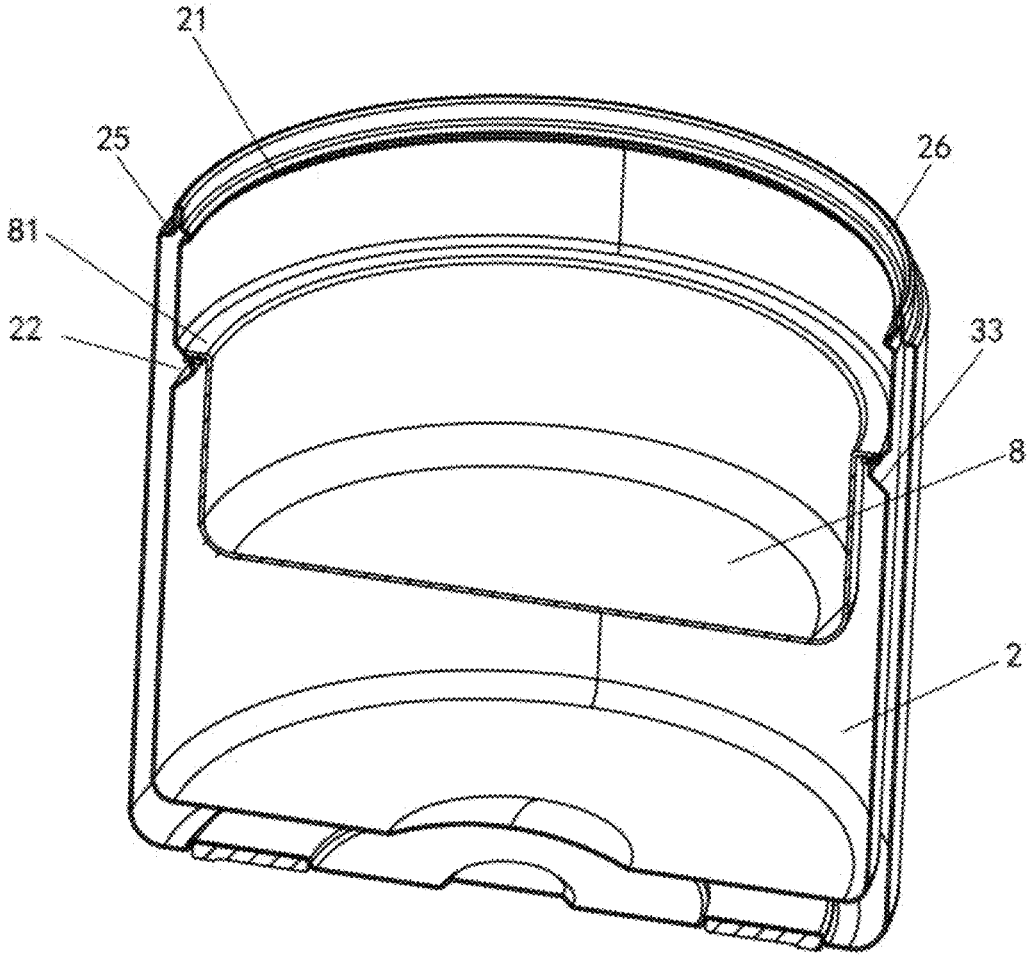
FIG. 3 is a sectional diagram of a canister body according to Embodiment I.
Figure 4:
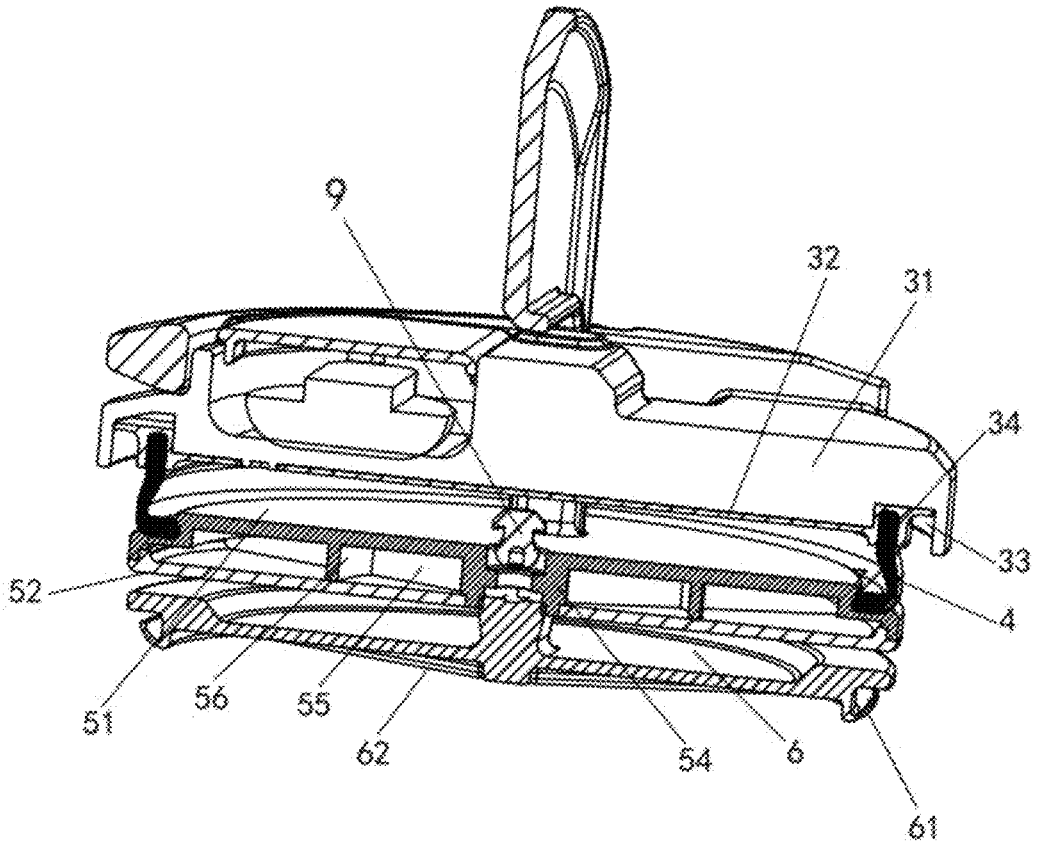
FIG. 4 is a sectional diagram of a thermal insulation cover according to Embodiment I.
Figure 5:
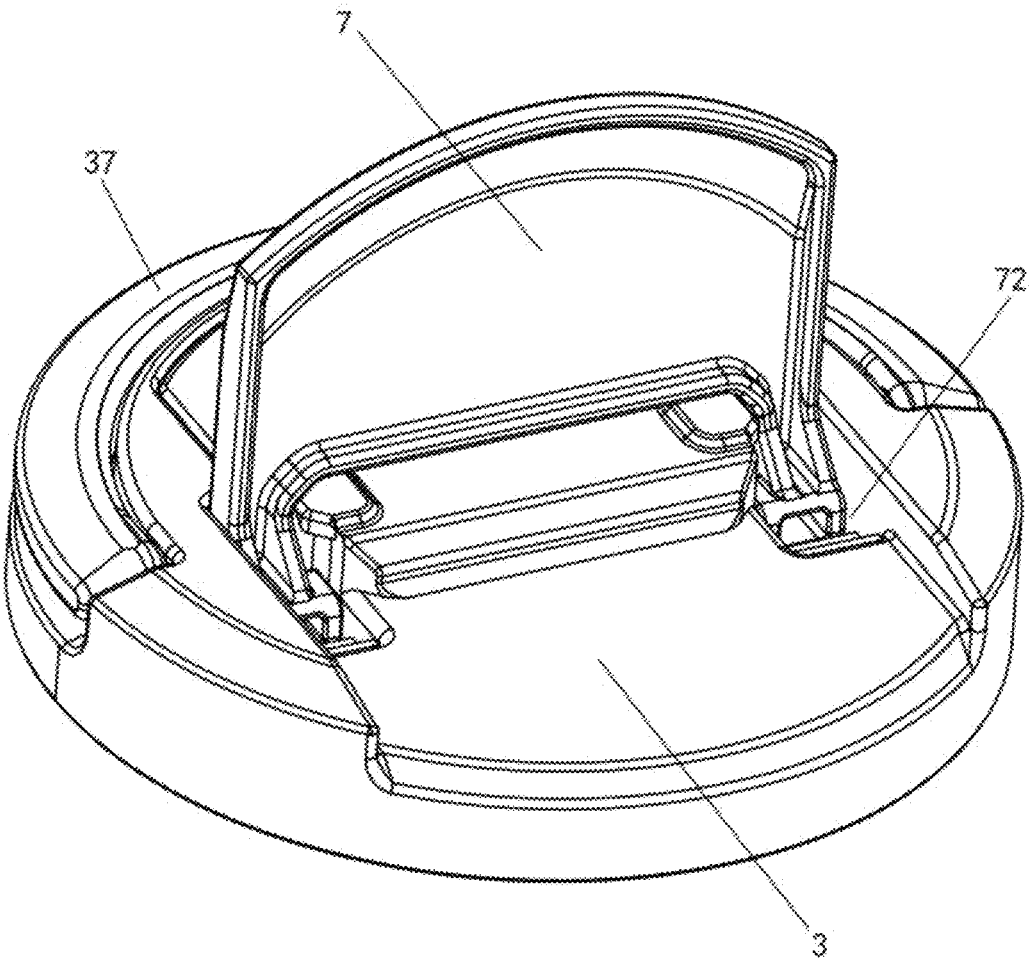
FIG. 5 is a schematic structural diagram of an upper cover body and a trigger according to Embodiment I.
Figure 6:
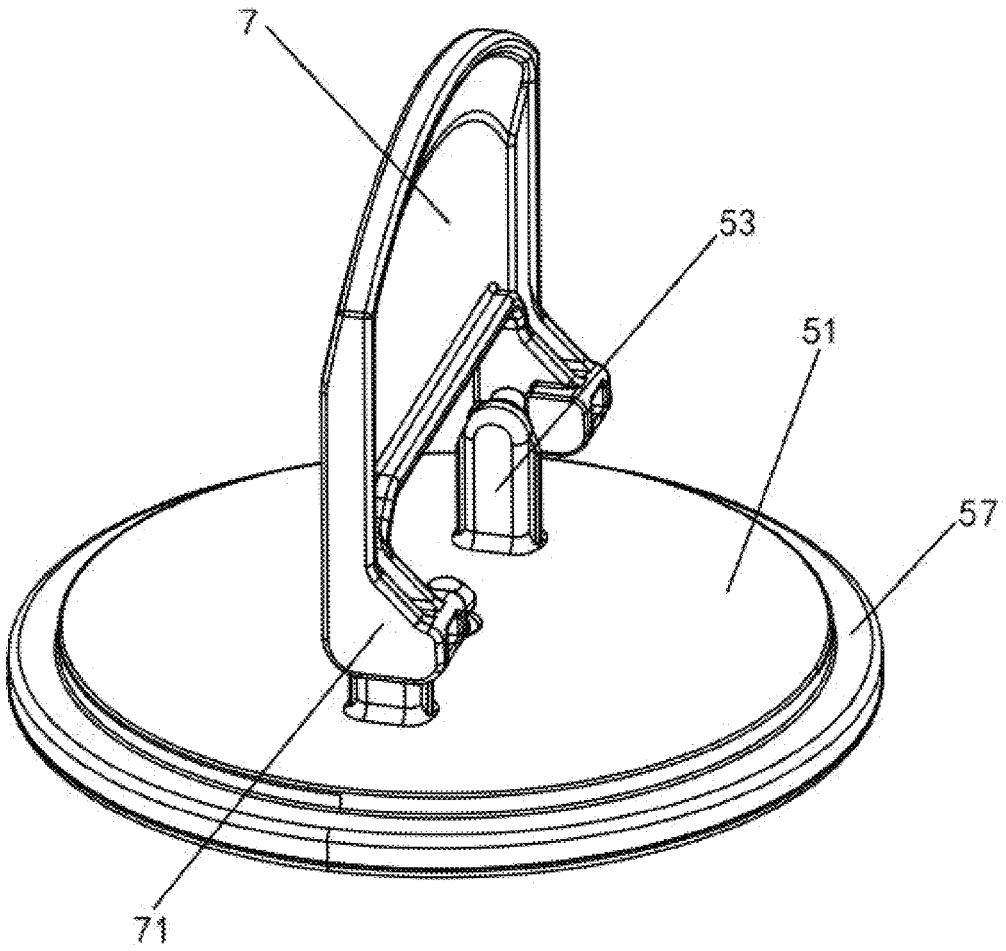
FIG. 6 is a connection structural diagram of an adjusting frame and the trigger according to Embodiment I.
Figure 7:
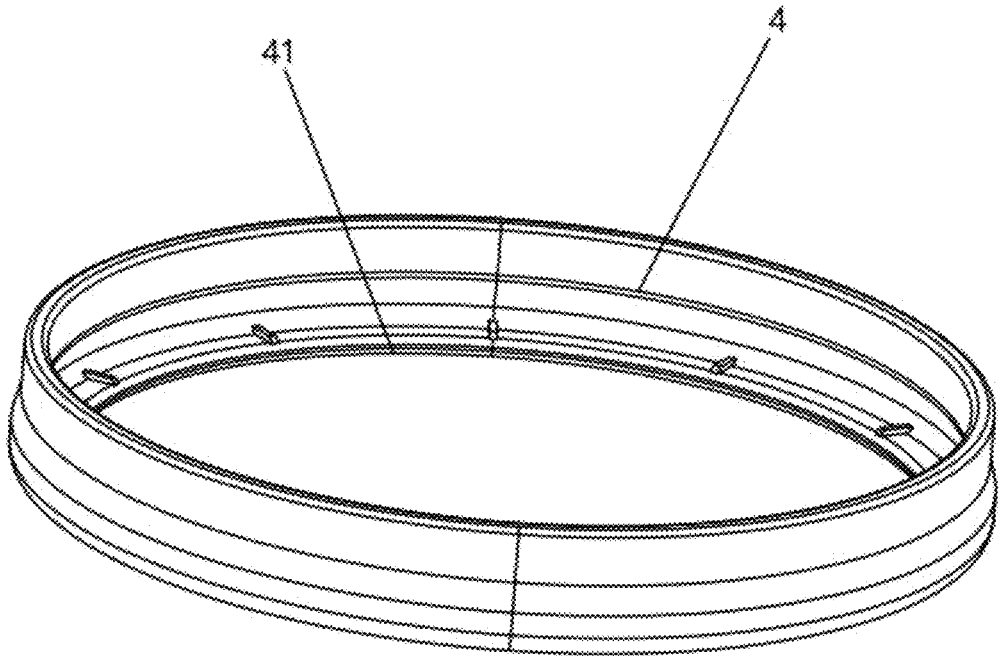
FIG. 7 is a schematic structural diagram of a sealing ring according to Embodiment I.
Figure 8:
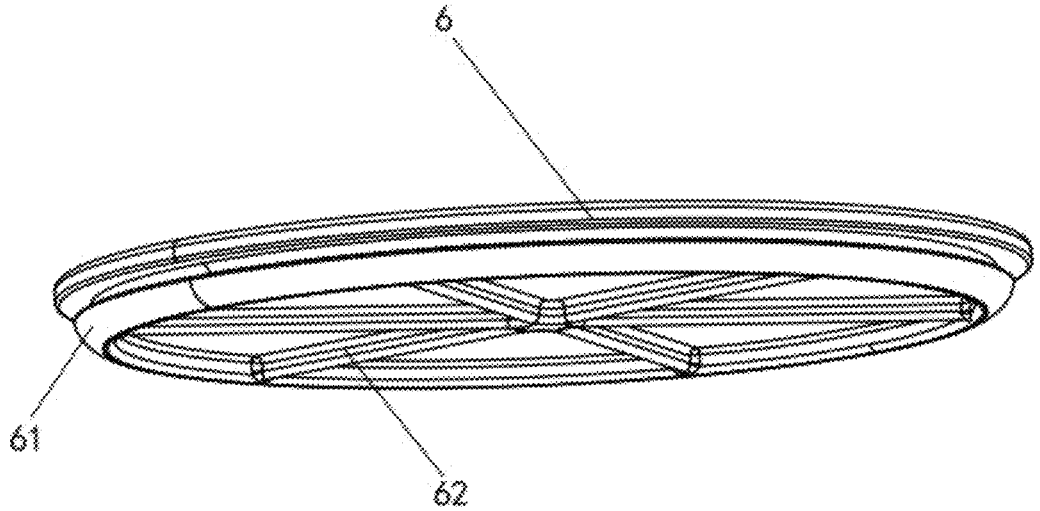
FIG. 8 is a schematic structural diagram of an inner cover body according to Embodiment I.

Referring to FIG. 1 to FIG. 8, a thermal insulation canister includes a canister body and a thermal insulation cover 1. The canister body includes an outer canister body 2 and an inner canister body 8, an inner wall of the outer canister body 2 is equipped with two circles of clamping edges protruding inward, the two clamping edges are respectively an upper clamping edge 21 and a lower clamping edge 22, and an inner circle diameter of the lower clamping edge 22 is less than an inner circle diameter of the upper clamping edge 21. An upper end of the inner canister body 8 is equipped with a retaining ring 81 folded outward, an outer diameter of the retaining ring 81 is less than an inner circle diameter of the upper clamping edge 21, and the outer diameter of the retaining ring 81 is greater than an inner circle diameter of the lower clamping edge 22. The inner canister body 8 can pass through the upper clamping edge 21 and be clamped above the lower clamping edge 22. The inner canister body 8 and the outer canister body 2 can be used to hold different foods.

The outer canister body 2 includes an outer casing 23 and an inner casing 24, and a vacuum layer is arranged between the outer casing 23 and the inner casing 24 as a spacer layer. In this design, the spacer layer is not filled with any substances and can effectively provide thermal insulation.

An annular pad 27 is embedded in a lower end surface of the outer casing 23, and a position of a lowest end of the annular pad 27 is lower than a position of a lowest end of the outer casing 23. The annular pad 27 is made of a heat-insulating and elastic material such as rubber, which can reduce collisions between the outer casing 23 and external objects such as tables, thereby prolonging the service life of the thermal insulation canister.

The thermal insulation cover 1 includes an upper cover body 3, a sealing ring 4, an adjusting frame 5 and a lower inner cover body 6. Furthermore, the upper cover body 3 includes an upper cover plate 31 and an upper protection plate 32. A lower end surface of the upper cover plate 21 is equipped with an upper installation slot, an outer edge of the upper protection plate 32 protrudes upward and is clamped into the upper installation slot, so that the upper protection plate 32 is fixed with the upper cover plate 31. To enhance the connection firmness between the upper protection plate 32 and the upper cover plate 31, a plurality of downward protruding clamping columns are arranged on the lower end surface of the upper cover plate 31, and a plurality of clamping holes are arranged at corresponding positions of the upper protection plate 32. The plurality of clamping columns are respectively inserted into the plurality of clamping holes, and the clamping columns are fixed with the clamping holes in an inserting manner.

A lower end surface of the upper protection plate is equipped with an outer ring groove 33 and an inner ring groove 34. The outer ring groove 33 is in insertion fit with an upper end of the canister body, and an upper end of the sealing ring 4 is inserted into the inner ring groove.

The adjusting frame 5 includes an adjusting plate 51 and a bottom plate 52, the bottom plate 52 is clamped and fixed on a lower end surface of the adjusting plate 51. A center of the lower end surface of the adjusting plate is equipped with a central shaft 54, the lower end surface of the adjusting plate 51 is further equipped with a plurality of spoke edges 55 and annular edges 56. The plurality of spoke edges 55 are arranged surrounding the central shaft 54, one end of the spoke edge 55 is connected to the central shaft 54, the other end of the spoke edge 55 extends to an outer edge of the adjusting plate 51, the annular edge 56 connects the plurality of the spoke edges 55. The spoke edges 55 and the annular edge 56 can increase the firmness of the adjusting frame 5, and also create a certain distance between the bottom plate 52 and the adjusting plate 51, thereby enhancing the thermal insulation performance of the thermal insulation cover 1.

An outer edge part of an upper end surface of the adjusting plate 51 is equipped with a downward recessed abutting groove 57, a lower end of the sealing ring 4 is fixedly equipped with a horizontally arranged abutting ring 41, and the abutting ring 41 is closely fitted with the abutting groove 57.

The upper cover body 3 is equipped with a trigger 7, each of two sides of the trigger 7 is equipped with a trigger connecting shaft 71. The upper cover body is further equipped with two installation holes 72, and one end of the trigger connecting shaft 71 is positioned within the installation hole 72 and is slidably connected to the installation hole 72. Two adjusting shafts 53 are fixedly installed on the upper end surface of the adjusting frame 5, each of upper ends of the two adjusting shafts 53 passes through the installation hole 72. A horizontally arranged cylinder is fixedly installed on the adjusting shaft 53, and a cylindrical groove is arranged on the trigger connecting shaft 71. The cylinder on the adjusting shaft 53 is clamped into the cylindrical groove, thus the trigger connecting shaft 71 is rotatably connected with the adjusting shaft 53.

The trigger 7 is of a cam structure, and the trigger pulls the adjusting frame 5 by the cam to make the sealing ring 4 stretch or slide, thereby locking the canister body 1. The trigger connecting shaft 71 includes a connecting portion placed on the same horizontal plane as the trigger 7 and a protruding portion perpendicular to the trigger 7, and the adjusting shaft 53 is connected with a junction of the protruding portion and the connecting portion of the trigger connecting shaft 71. When the trigger 7 is in a vertical state perpendicular to the thermal insulation cover 1, it is in an opened state; when the trigger 7 is in a horizontal state attached to the surface of the thermal insulation cover 1, it is in a closed state. When the trigger 7 rotates from the opened state to the closed state, the protruding portion of the trigger connecting shaft 71 will abut against an upper end surface of the upper cover body 3. During the continuous rotation of the trigger 7, the junction of the protruding portion and the connecting portion of the trigger connecting shaft 71 will move upward until the trigger 7 is completely rotated to a state of being attached to the thermal insulation cover 1. At this time, the junction of the protruding portion and the connecting portion of the trigger connecting shaft 71 moves to a highest position, and the trigger 7 changes to the closed state.

When the trigger 7 changes from the opened state to the closed state, the trigger connecting shaft 71 will drive the adjusting shaft 53 to move upward. The adjusting shaft 53 drives the adjusting frame 5 to move upward. After the adjusting frame 5 moves upward from the initial position, it will drive the lower end surface of the sealing ring 4 to move upward. Since the upper end of the sealing ring 4 will not move, the sealing ring 4 will be compressed. Since the lower end of the sealing ring 4 is inclined outward, when compressed, the sealing ring 4 will protrude outward, increasing the outermost diameter of the sealing ring 4. After the thermal insulation cover 1 is placed on the canister body, the part of the sealing ring 4 exposed below the inner ring groove 34 is located below the upper clamping edge 21. When the sealing ring 4 is compressed, the protruding part of the sealing ring 4 is also located below the upper clamping edge 21 and is in close contact with the lower side surface of the upper clamping edge 21. The outermost diameter of the compressed sealing ring 4 is greater than the inner diameter of the upper clamping edge 21, so the sealing ring 4 cannot pass through the upper clamping edge 21, thereby fixing the thermal insulation cover 1 and the canister body.

When the thermal insulation cover 1 needs to be removed from the canister body, it is only necessary to rotate the trigger 7 so that the trigger 7 changes from the closed state to the opened state. In the opened state, the sealing ring 4 will not be compressed, that is, it will not be in contact with the upper clamping edge 21. In this design, the sealing ring 4 is made of an elastic silicone material, which can be used for a long time and has very good sealing performance.

An upper end of the outer casing 23 is equipped with an abutting platform 25 recessed inward, a part of the outer canister body 2 positioned above the abutting platform 25 is an insertion portion 26. The transverse width of the insertion portion 26 is less than that of the remaining position of the outer canister body 2, so that the insertion portion 26 can be inserted into the outer ring groove 33. And the side wall of the outer ring groove 33, that is, the lower end surface of the outermost part of the upper cover plate 31, will abut against the position of the abutting platform 25. Then both the abutting platform 25 and the insertion portion 26 of the outer canister body 23 can position the thermal insulation cover 1 onto the canister body, and the relative position between the thermal insulation cover 1 and the canister body enables the thermal insulation cover 1 to better achieve the thermal insulation of the canister body.

The inner cover body 6 is clamped and fixed on the upper end surface of the inner canister body 8. A plurality of reinforcing edges 62 are fixedly installed on the lower end surface of the inner cover body 6, and the reinforcing edges 62 can increase the strength of the inner cover body 6. The lower end surface of the inner cover body 6 is provided with a circle of sealing ring 61. The outer side of the sealing ring 61 is arc-shaped, and the diameter of the outermost side of the sealing ring 61 is smaller than that of the outermost side of the inner cover body 6. The sealing ring 61 can be inserted into the inner canister body 8, and the inner cover body 6 will abut against the upper end surface of the inner canister body 8 to prevent the food in the inner canister body 8 from being cross-flavored with the food in the outer canister body 2.

In order to prevent the canister body from being damaged due to excessive air pressure in the canister, a pressure valve 9 can be further installed on the central shaft 54 of the adjusting frame 5. When the air pressure in the canister exceeds the set value, the pressure valve 9 opens, allowing the gas in the canister to pass through the adjusting frame for pressure relief.

The upper end surface of the upper cover body 3 is provided with a storage groove 35. The storage groove 35 can be used to place tableware, small snacks, etc. The storage groove 35 is equipped with a storage cover 36. One side of the storage cover 36 is hinged to the storage groove 35, and the other side of the storage cover 36 is clamped and fixed to the storage groove 35. After the storage cover 36 is covered on the storage groove 35, it can prevent the objects in the storage groove 35 from falling.

The upper cover body 3 is further equipped with a handle ring 37. The handle ring 37 is hingedly connected to the upper cover body 3. When the handle ring 37 is erected, the thermal insulation canister can be carried by lifting, making the thermal insulation canister more convenient to carry.

Each structure in this design can be completely detached. When cleaning, each part on the thermal insulation cover can be disassembled for convenient cleaning.

Embodiment II

Figure 9:
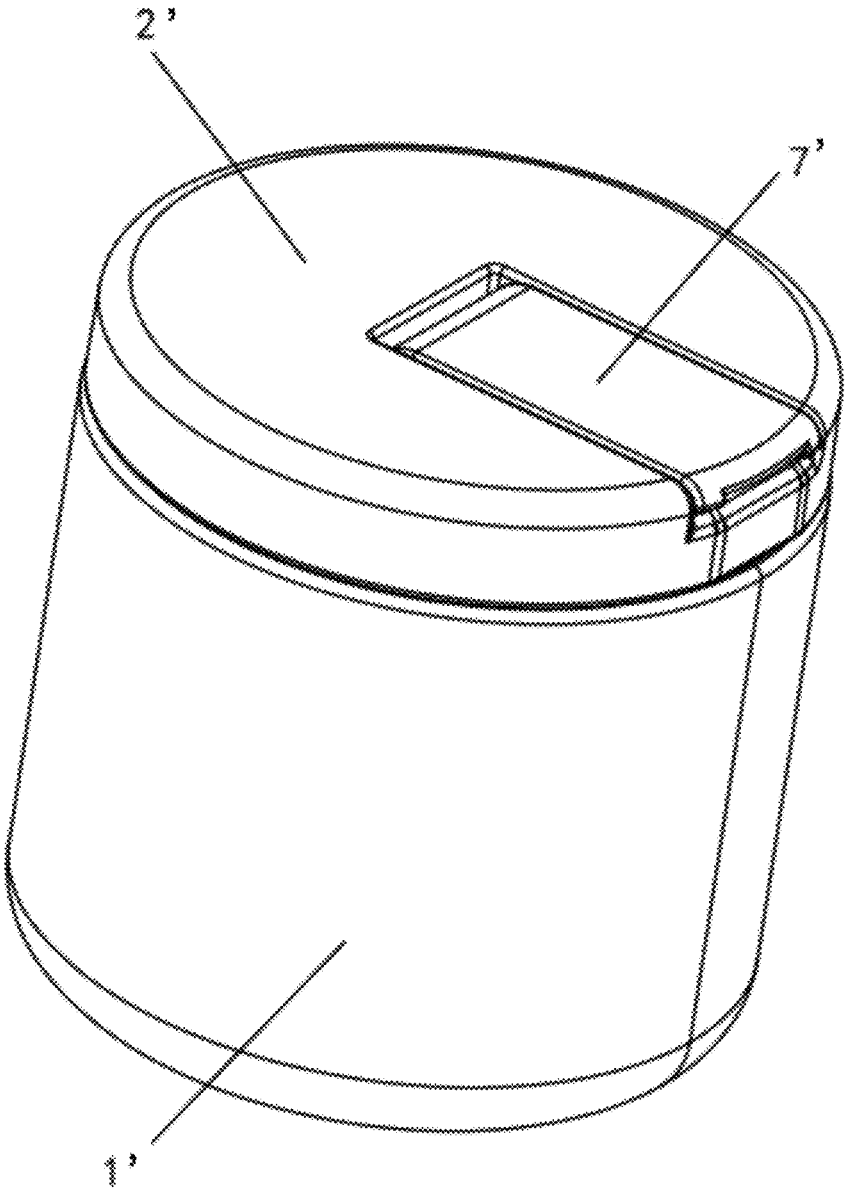
FIG. 9 is a schematic structural diagram when the trigger is closed according to Embodiment II.
Figure 10:
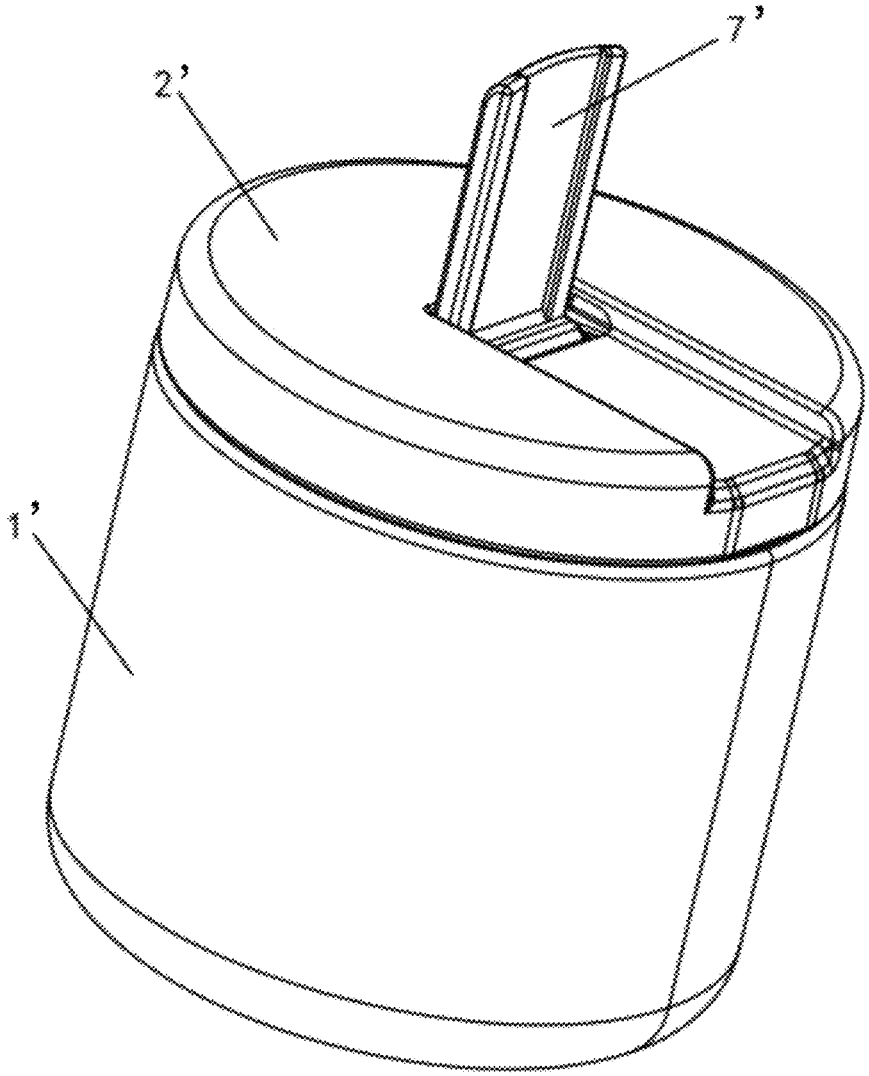
FIG. 10 is a schematic structural diagram when the trigger is opened according to Embodiment II.
Figure 11:
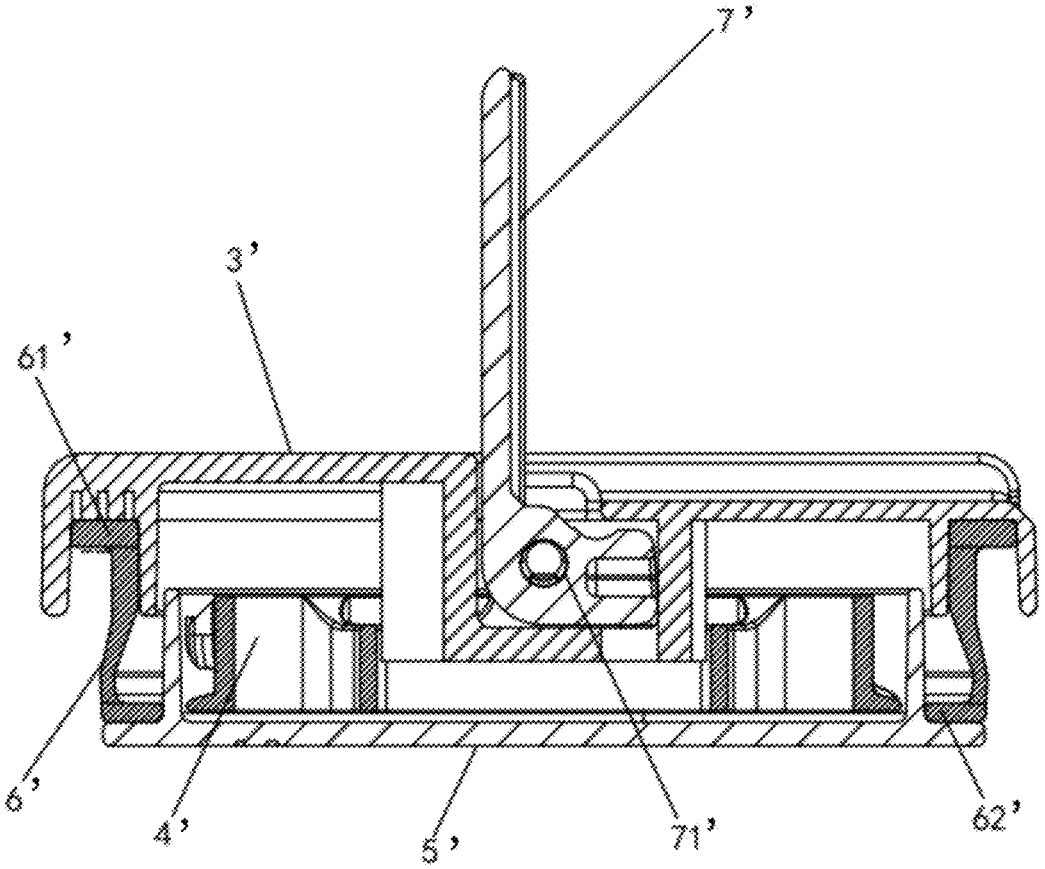
FIG. 11 is a sectional diagram of the thermal insulation cover according to Embodiment II.
Figure 12:
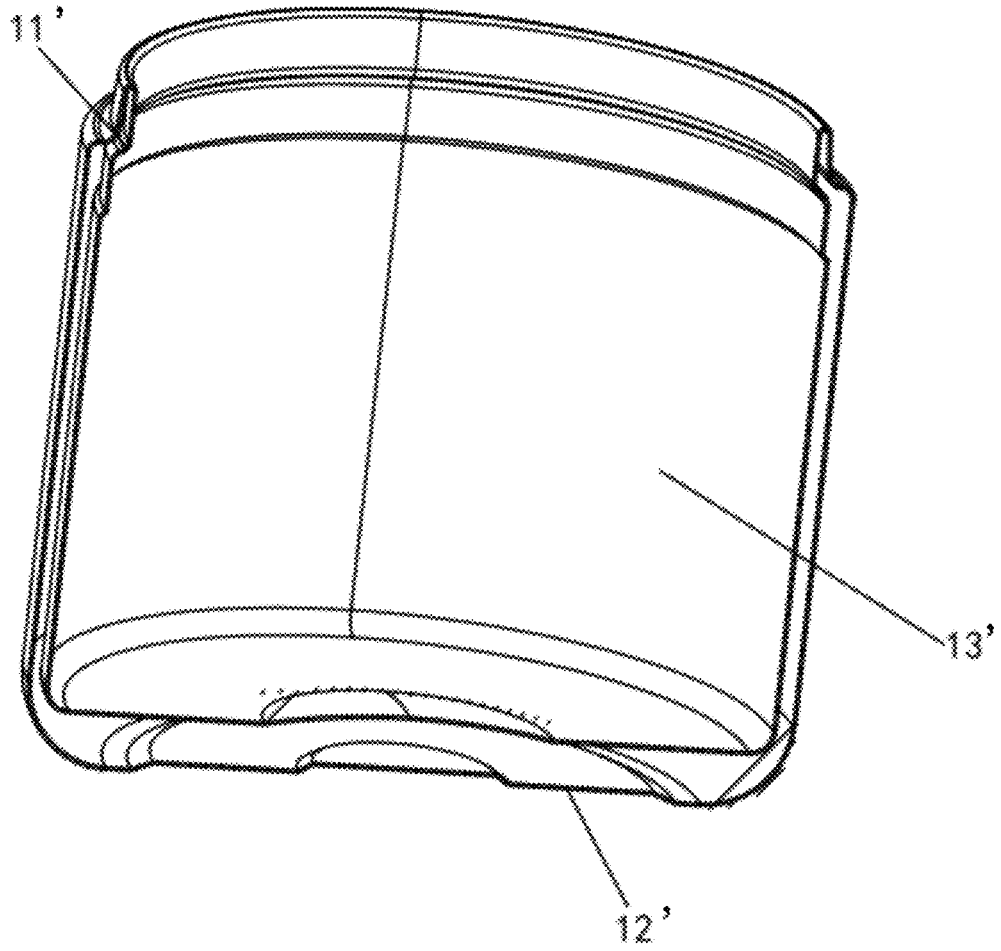
FIG. 12 is a sectional diagram of the canister body according to Embodiment II.
Figure 13:
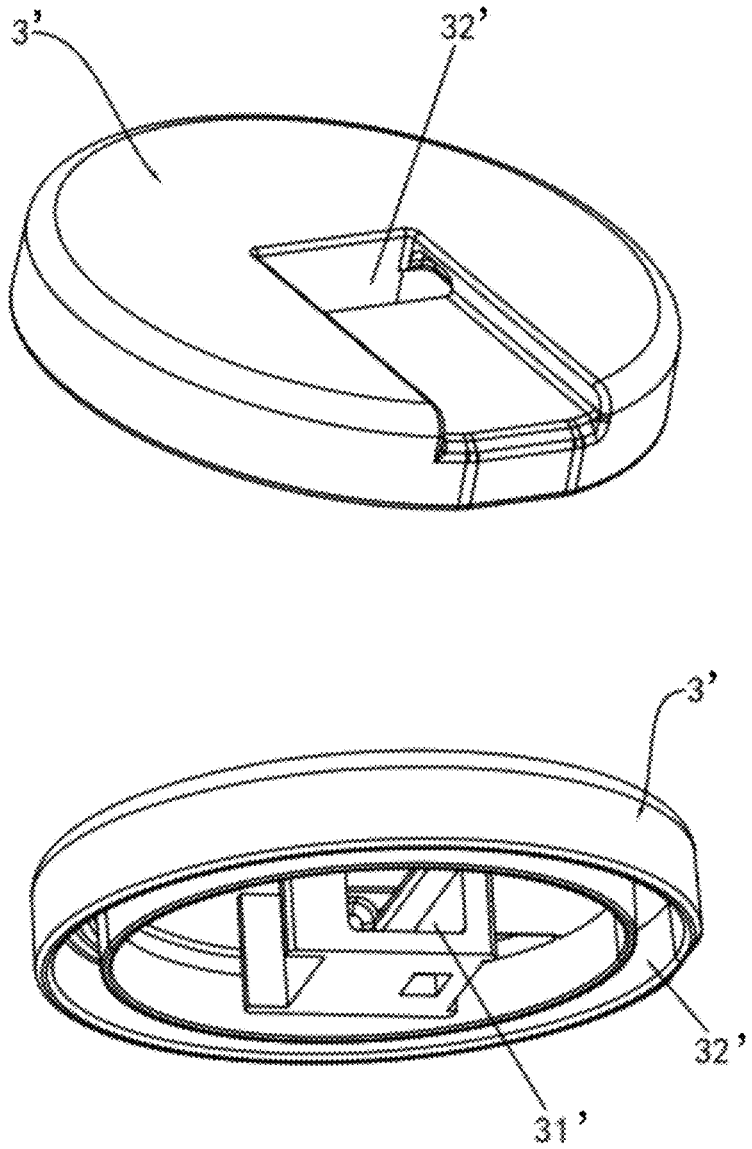
FIG. 13 is a schematic structural diagram of the upper cover body in two directions according to Embodiment II.
Figure 14:
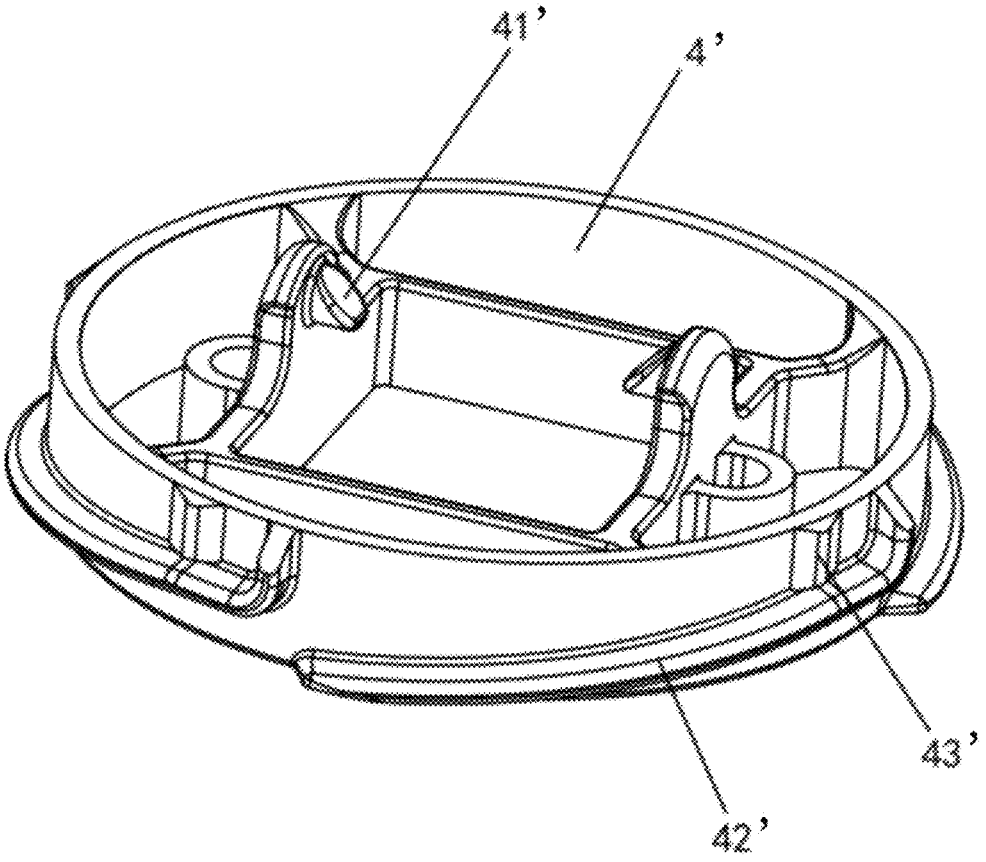
FIG. 14 is a schematic structural diagram of the adjusting frame according to Embodiment II.
Figure 15:
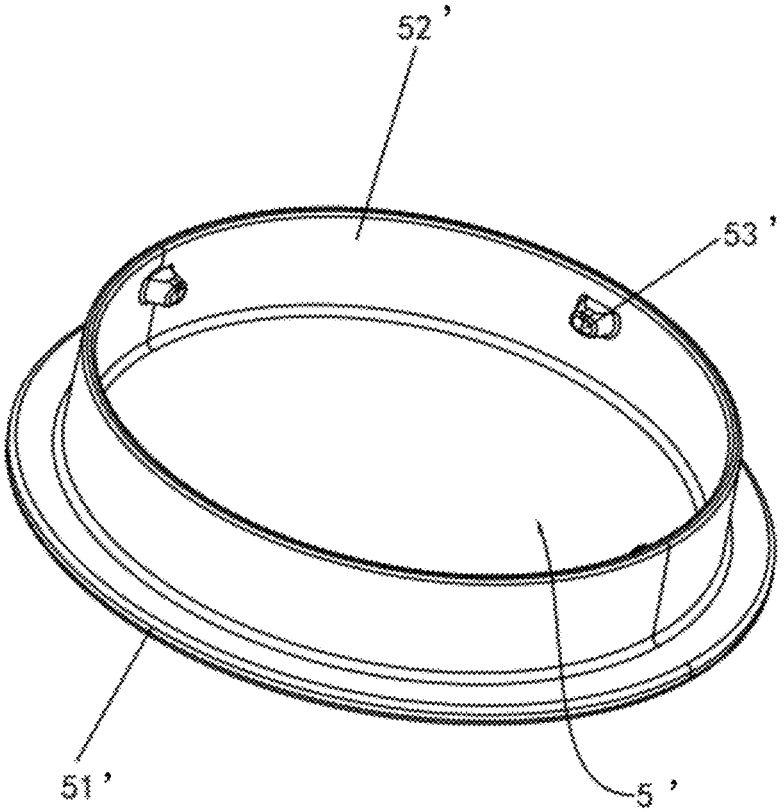
FIG. 15 is a schematic structural diagram of a lower cover body according to Embodiment II.
Figure 16:
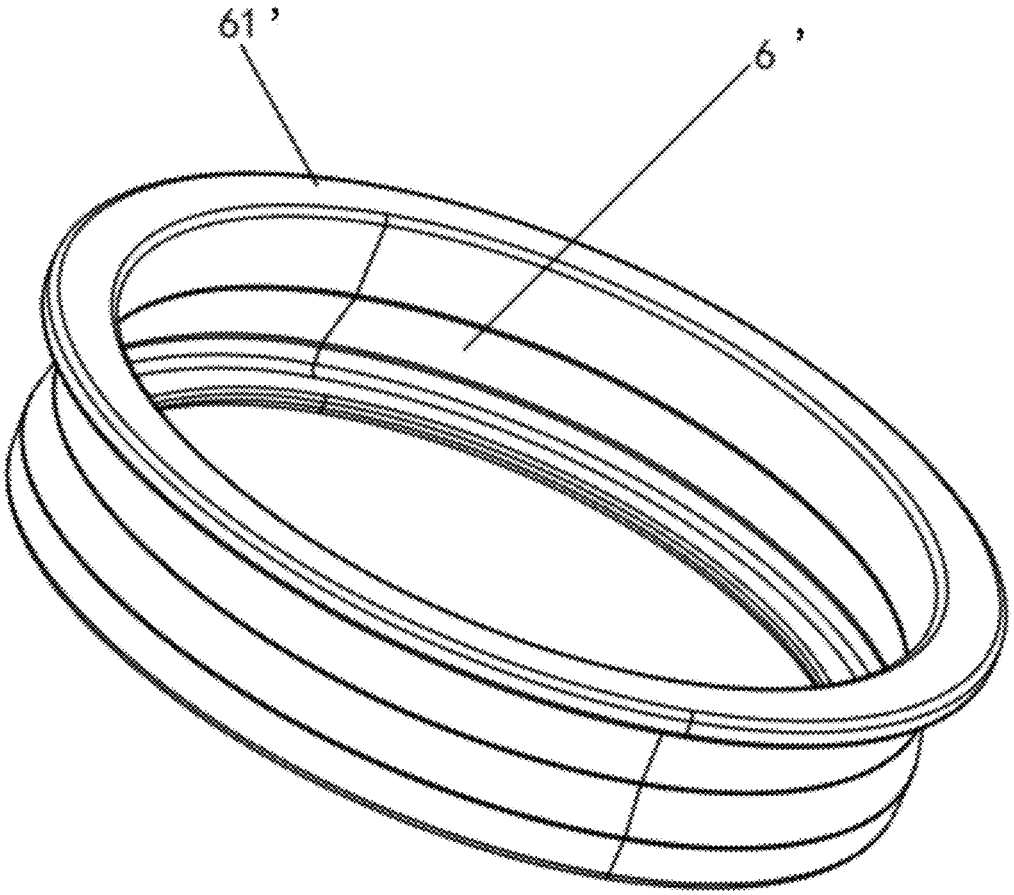
FIG. 16 is a schematic structural diagram of the sealing ring according to Embodiment II.

Referring to FIG. 9 to FIG. 16, a thermal insulation canister includes a canister body 1' and a thermal insulation cover 2'. The canister body 1' is of a double-layer design. The canister body 1' includes an outer casing 12' and an inner casing 13'. There is a vacuum layer between the outer casing 12' and the inner casing 13', which can better keep the food in the canister body 1' warm. In this design, both the outer casing 12' and the inner casing 13' are made of food-grade stainless steel and can hold food. On the outer wall of the outer casing 122, a plastic layer is also provided for heat insulation and can increase the thermal insulation effect of the canister body 1' itself.

The thermal insulation cover 22 includes an upper cover body 32, an adjusting frame 4', a lower cover body 5' and a sealing ring 62. All the components in the thermal insulation cover 2' can be detached for convenient separate cleaning.

The upper cover body 3' is further provided with an installation slot 32'. A trigger 7' is arranged inside the installation slot 32'. One end of the trigger 7' is positioned inside the installation slot 32' and is rotatably fitted with the installation slot 32'. The upper end surface of the upper cover body 3' is also provided with a trigger groove. When the trigger 7' rotates to the horizontal direction, the trigger 7' will be located inside the trigger groove. At this time, the upper end surface of the trigger 7' is at the same plane position as the upper end surface of the upper cover body 3', thus keeping the upper end surface of the upper cover body 3' flat.

The installation slot 32' has no side walls on two sides. That is, the two sides of the installation slot 32' communicate with the space where the adjusting frame 4' is located. The adjusting frame 4' is symmetrically provided with two adjusting columns 412, and the two adjusting columns 41' extend into the installation slot 32' from the two sides of the installation slot 32' where there are no side walls. The adjusting column 41' is in the shape of a horizontally placed cylinder obliquely truncated at one end. That is, one end of the horizontally placed adjusting column 41' is provided with an inclined surface. The two adjusting columns 41' will be inserted into the column holes 71' on one side of the trigger 7' and are rotatably connected with the column holes 71'. The trigger 7' is in an overall L shape, and the adjusting columns 41' are connected to the bent part of the trigger 72. When the trigger 7' rotates from the vertical direction to the horizontal direction, firstly, one end of the trigger 7' will abut against the bottom surface of the installation slot 32'. Subsequently, this will make the arc at the bent part of the trigger 7' move upward. Since the amplitude of the arc is relatively small, it can be approximately regarded that the bent part of the trigger 7' moves upward. Consequently, at this time, the trigger 7' will drive the adjusting columns 41' to move upward, thereby making the adjusting frame 4' move upward as a whole.

When the trigger 7' rotates from the horizontal direction to the vertical direction, that is, the opposite of the above actions, the trigger 7' will not exert an upward pulling force on the adjusting frame 42, so that the adjusting frame 4' will return downward to its initial position under the action of gravity and the elastic force of the sealing ring 62.

The lower cover body 5' is clamped and connected with the adjusting frame 4'. The lower cover body 5' includes a lower cover plate 51' and a lower annular sleeving plate 52'. The lower annular sleeving plate 52' is in a shape of an annular cylinder, and the lower cover plate 51' is a circular plate. The lower annular sleeving plate 52' is positioned on the upper end surface of the lower cover plate 51'. The diameter of the lower annular sleeving plate 52' is less than that of the lower cover plate 51'. A plurality of inner clamping blocks 53' are fixedly installed on the inner wall of the lower annular sleeving plate 52'.

The outer side wall of the adjusting frame 4' is also circular. The diameter of the adjusting frame 4' is less than that of the lower annular sleeving plate 52', so the lower annular sleeving plate 52' can be sleeved on the outside of the adjusting frame 42. A plurality of outer clamping stripes 42' are fixedly installed on the outer side wall of the adjusting frame 4'. The outer clamping stripes 42' are obliquely arranged along the outer wall of the adjusting frame 4', that is, the shape of the outer clamping stripes 42' is similar to a section of a screw thread, presenting a spiral ascending structure. In this design, the horizontal span of the outer clamping stripes 42' is one-fourth of the diameter of the outer wall of the adjusting frame 4, and a total of four outer clamping stripes 42' are provided in this design. The four outer clamping stripes 42' are evenly distributed on the outer side wall of the adjusting frame 4'. The lowest end of the outer clamping stripes 42' is located at the lowest end of the outer wall of the adjusting frame 4', and the highest end of the outer clamping stripes 42' is located at the highest end of the outer wall of the adjusting frame 42. The outer clamping stripes 42' are bent into the vertical direction when approaching the highest end position of the adjusting frame 42. The outer clamping block 43' is provided at the position adjacent to the highest part of the outer clamping stripes 42', and the distance between the outer clamping block 43' and the highest end of the outer clamping stripes 42' is the clamping groove.

When fixing the lower cover body 5' and the adjusting frame 4', first sleeve the upper end of the lower annular sleeving plate 52' onto the lower end of the adjusting frame 4'. Then rotate the lower cover body 5' so that the inner clamping blocks 53' on the inner wall of the lower annular sleeving plate 52' move along the upper end surface of the outer clamping stripes 42'. Both sides of the inner clamping blocks 53' and the outer clamping blocks 43' are inclined surfaces. Consequently, the inner clamping blocks 53' can move over the outer clamping blocks 43' and enter into the clamping groove. At this time, without being subjected to relatively large external forces, the lower cover body 5' will not be detached from the adjusting frame 42. When it is necessary to detach the lower cover body 5' and the adjusting frame 4', just rotate the lower cover body 5' in the reverse direction to make the inner clamping blocks 53' move out of the clamping groove, and then the lower cover body 5' can be detached from the adjusting frame 4'.

The lower cover body 5' and the adjusting frame 4' can also be connected through screw threads or a structure of buckles and sliding grooves, enabling them to be detached for convenient cleaning.

The cross-sections of both the upper end portion and the lower end portion of the sealing ring 6' are arranged in the vertical direction. Moreover, the lower end portion of the sealing ring 6' is located at the outer position below the upper end portion. The middle portion of the sealing ring 62 connects the upper end portion and the lower end portion, and the middle portion is arranged obliquely. The upper end portion of the sealing ring 6' is provided with an upper abutting ring 61' that is bent outward and is perpendicular to the upper end portion of the sealing ring 62. The lower end portion of the sealing ring 6' is provided with a lower abutting ring 62' that is bent inward and is perpendicular to the lower end portion of the sealing ring 6'.

The lower end surface of the upper cover body 32 is provided with an annular groove 312, and the upper abutting ring 61' abuts against the top surface of the annular groove 31'. Since the diameter of the lower cover plate 51' is greater than that of the lower annular sleeving plate 52', and the centers of the lower cover plate 51' and the lower annular sleeving plate 52' are located on the same straight line, a part of the lower cover plate 51' will be exposed outside the lower annular sleeving plate 52', and the lower abutting ring 62' abuts against the side of the lower cover plate 51' that is exposed outside the lower annular sleeving plate 522.

Since the overall cross-section of the sealing ring 6' presents a shape where the upper end portion is on the inner side and the lower end portion is on the outer side, when the sealing ring 6' is subjected to pressure in the vertical direction, two situations will occur, that is, the upper end portion bends inward or the lower end portion bends outward. Moreover, as the upper end portion of the sealing ring 62 abuts against the side wall of the annular groove 31', which prevents the upper end portion of the sealing ring 6' from bending inward. And there is no obstruction in the direction outside the lower end portion of the sealing ring 62, so the lower end portion of the sealing ring 6' can bend outward.

The inner wall of the canister body 1' is provided with a clamping structure 112. The clamping structure 11' is formed by bending the upper end of the canister body 1 inward. The diameter of the clamping structure 11' is less than that of the inner cavity of the canister body 1'. Therefore, when the lower end portion of the sealing ring 6' bends outward, the overall diameter of the sealing ring 62 increases, so that the sealing ring 6' gets stuck below the clamping structure 11' and cannot pass through the clamping structure 112, thus realizing the fixation between the thermal insulation cover 2' and the canister body 12.

The sealing ring 6' is made of a soft and elastic material. In this design, silica gel is adopted as the material. When not affected by external forces, the sealing ring 6' will restore to its original shape. Therefore, when the trigger 7' rotates from the horizontal state to the vertical state, the sealing ring 6' will restore to its original shape, that is, the sealing ring 6' will no longer be in contact with the clamping structure 11'. At this time, the thermal insulation cover 2' can be removed from the canister body 12.

Each structure in the design can be completely detached. When it is necessary to clean them, the lower cover body can be rotated, and then the lower cover body will be detached from the adjusting frame. Parts like the sealing ring can then be detached one by one for cleaning, which makes it convenient to clean them.

The above is only the preferred embodiments of the present invention, and is not intended to limit the present invention. Any modifications, equivalent replacements and improvements that are made within the spirit and principle of the present invention shall fall within the protection scope of the present invention.

What is claimed is:

1. A thermal insulation canister, comprising:

a canister body; and a thermal insulation cover, wherein the thermal insulation cover comprises an upper cover body, a sealing ring, an adjusting frame, a pressure valve, a trigger and an inner cover body, the trigger is arranged on the upper cover body, each of two sides of the trigger is equipped with a trigger connecting shaft, the upper cover body is equipped with two installation holes, and one end of the trigger connecting shaft is positioned within the installation holes and is slidably connected to the installation holes; two adjusting shafts are fixedly installed on an upper end surface of the adjusting frame, each of upper ends of the two adjusting shafts passes through the installation holes and is rotatably connected with the trigger connecting shaft, the adjusting shaft is connected with a junction of a raised portion and a connecting portion of the trigger connecting shaft, the trigger connecting shaft is configured to drive the adjusting shaft to move in a vertical direction, the sealing ring is positioned between the upper cover body and the adjusting frame, an upper end of the sealing ring is inserted and fixed with a lower end surface of the upper cover body, a lower end of the sealing ring is contacted with the upper end surface of the adjusting frame, a thermal insulation layer is arranged inside the adjusting frame, the pressure valve is installed on the adjusting frame, and the pressure valve is configured to release pressure in the canister body; the canister body is further equipped with an inner canister body, the inner cover body is fixed on an upper end of the inner canister body, the inner canister body is clamped and fitted with an inner wall of the canister body, the trigger is of a cam structure, and the trigger pulls the adjusting frame by the cam structure to make the sealing ring stretch and slide, thereby locking the canister body, wherein the upper cover body comprises an upper cover plate and an upper protection plate, the upper protection plate is fixed on a lower end surface of the upper cover plate, the lower end surface of the upper cover plate is equipped with an upper installation slot, an outer edge of the upper protection plate protrudes upward and is clamped into the upper installation slot, a lower end surface of the upper protection plate is equipped with an outer ring groove and an inner ring groove, an upper end of the canister body is inserted and fitted with the outer ring groove, and an upper end of the sealing ring is inserted and fitted with the inner ring groove, wherein the adjusting frame comprises an adjusting plate and a bottom plate, the thermal insulation layer is arranged between the adjusting plate and the bottom plate, the bottom plate is clamped and fixed on a lower end surface of the adjusting plate, a center of the lower end surface of the adjusting plate is equipped with a central shaft, the lower end surface of the adjusting plate is further equipped with a plurality of spoke edges and annular edges, the plurality of spoke edges are arranged surrounding the central shaft, one end of the spoke edge is connected to the central shaft, the other end of the spoke edge extends to an outer edge of the adjusting plate, a diameter of the annular edge is greater than a diameter of the central shaft, the annular edge connects all of the spoke edges, the spoke edge and the annular edge are configured to increase firmness of the adjusting frame, an outer edge part of an upper end surface of the adjusting plate is equipped with a downward recessed abutting groove, a lower end of the sealing ring is equipped with an abutting ring, and the abutting ring abuts against an upper end surface of the abutting groove.

2. The thermal insulation canister according to claim 1, wherein a lower end surface of the inner cover body is equipped with a circle of sealing ring, an outer side of the sealing ring is in an arc shape, a diameter of an outermost side of the sealing ring is less than a diameter of an outermost side of the inner cover body, a plurality of reinforcing edges are fixedly installed on the lower end surface of the inner cover body, and the reinforcing edge is configured to increase strength of the inner cover body.

3. The thermal insulation canister according to claim 2, wherein the canister body is further equipped with an outer canister body, an inner wall of the outer canister body is equipped with two circles of clamping edges protruding inward, the two clamping edges are respectively an upper clamping edge and a lower clamping edge, an inner circle diameter of the lower clamping edge is less than an inner circle diameter of the upper clamping edge, the upper end of the inner canister body is equipped with a retaining ring folded outward, an outer diameter of the retaining ring is less than an inner circle diameter of the upper clamping edge, and the outer diameter of the retaining ring is greater than an inner circle diameter of the lower clamping edge.

4. The thermal insulation canister according to claim 3, wherein the outer canister body comprises an outer casing and an inner casing, an interlayer thermal insulation layer is arranged between the outer casing and the inner casing, the upper clamping edge and the lower clamping edge are respectively arranged on the inner casing, an upper end of the outer casing is equipped with an abutting platform recessed inward, a distance between the outer casing and the inner casing positioned above the abutting platform is less than a distance between the outer casing and the inner casing positioned below the abutting platform.

5. The thermal insulation canister according to claim 4, wherein a part of the outer canister body positioned above the abutting platform is an insertion portion, the insertion portion of the outer canister body is in insertion fit with the outer ring groove, and a lower end surface of an outermost side of the upper cover body abuts against the abutting platform.

6. The thermal insulation canister according to claim 4, wherein an annular pad is embedded in a lower end surface of the outer casing, the annular pad is fixedly connected to the outer casing, and a position of a lowest end of the annular pad is lower than a position of a lowest end of the outer casing.

7. The thermal insulation canister according to claim 1, wherein an upper end surface of the upper cover body is equipped with a storage groove, the storage groove is configured to place tableware, the storage groove is equipped with a storage cover, a first side of the storage cover is hinged to the storage groove, and a second side of the storage cover is clamped and fixed to the storage groove.

8. The thermal insulation canister according to claim 1, wherein the upper cover body is further equipped with a handle ring, and the handle ring is hinged to the upper cover body.

9. A thermal insulation canister, comprising:

a canister body; and a thermal insulation cover, wherein the thermal insulation cover comprises an upper cover body, an adjusting frame, a lower cover body and a sealing ring, the upper cover body is equipped with an installation slot, a trigger is arranged inside the installation slot, one end of the trigger is positioned inside the installation slot and is rotatably fitted with the installation slot, the adjusting frame is symmetrically equipped with two adjusting columns, an upper end surface of one end of the adjusting column is an inclined plane, the two adjusting columns are respectively positioned on two sides of the installation slot without a sidewall, the two sides of the installation slot are not equipped with the sidewall, the adjusting column is extended into the installation slot, the trigger is equipped with a column hole channel, the adjusting column is inserted into the column hole channel and is rotatably connected to the column hole channel, the lower cover body is clamped and connected with the adjusting frame, the sealing ring is positioned at an outer edge of the lower cover body, an upper end of the sealing ring is snapped into a lower end surface of the upper cover body, a lower end of the sealing ring abuts against an upper end surface of the lower cover body, the lower cover body moves up and down following the adjusting frame, so that the sealing ring is compressed or stretched, a clamping structure is arranged at an upper position of an inner cavity of the canister body, when the sealing ring is compressed, it is clamped and fixed with the clamping structure, when the sealing ring is stretched, it is slidably connected with the clamping structure, the trigger is of a cam structure, and the trigger pulls the adjusting frame by the cam to make the sealing ring stretch or slide, thereby locking the canister body, wherein the lower end surface of the upper cover body is equipped with an annular groove, the upper end of the sealing ring is equipped with an upper abutting ring bent outward, the upper abutting ring is perpendicular to the upper end of the sealing ring, a transverse width of the upper abutting ring is equal to a width of the annular groove, the lower end of the sealing ring is equipped with a lower abutting ring bent inward, the lower cover body comprises a lower cover plate and a lower annular sleeving plate, the lower annular sleeving plate is positioned on an upper end surface of the lower cover plate, a diameter of the lower cover plate is greater than a diameter of the lower annular sleeving plate, and the lower abutting ring is sleeved on an outside of the lower annular sleeving plate and is attached to the upper end surface of the lower cover plate.

10. The thermal insulation canister according to claim 9, wherein cross-sections of the upper end and the lower end of the sealing ring are arranged in a vertical direction, the lower end of the sealing ring is positioned at an outer position below the upper end, a middle part of the sealing ring is connected to the upper end and the lower end, and the middle part is arranged in an inclined manner.

11. The thermal insulation canister according to claim 9, wherein an outer sidewall of the adjusting frame is also circular, a diameter of the adjusting frame is less than the diameter of the lower annular sleeving plate, the lower annular sleeving plate is sleeved on an outside of the adjusting frame, a plurality of outer clamping stripes are fixedly arranged on the outer sidewall of the adjusting frame, the outer clamping stripes are arranged obliquely along an outer wall of the adjusting frame, a plurality of inner clamping blocks are fixedly arranged on an inner wall of the lower annular sleeving plate, the inner clamping block is in sliding fit with the outer clamping stripe, an outer clamping block is arranged adjacent to a highest position of the outer clamping stripe, each of two sides of the inner clamping block and the outer clamping block is inclined plane, and the inner clamping block is clamped onto the outer clamping stripe through the outer clamping block.

12. The thermal insulation canister according to claim 9, wherein the canister body is of a double-layer design, the canister body comprises an outer casing and an inner casing, the clamping structure is formed by bending an upper end of the canister body inward, and a diameter of the clamping structure is less than a diameter of the inner cavity of the canister body.

* * * * *